US010143883B2

(12) United States Patent
Jolly

(10) Patent No.: US 10,143,883 B2
(45) **Date of Patent: *Dec. 4, 2018**

(54) EXERCISE RING FOR IMPROVING STRENGTH AND FLEXIBILITY OF A BODY PART

(71) Applicant: Mission Competition Fitness Equipment, Redondo Beach, CA (US)

(72) Inventor: Michael Jolly, Redondo Beach, CA (US)

(73) Assignee: Mission Competition Fitness Equipment, Redondo Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/415,478

(22) Filed: Jan. 25, 2017

(65) Prior Publication Data

US 2017/0128767 A1 May 11, 2017

Related U.S. Application Data

(63) Continuation-in-part of application No. 13/457,371, filed on Apr. 26, 2012, now Pat. No. 9,873,015, (Continued)

(51) Int. Cl.
*A63B 21/00* (2006.01)
*A63B 21/02* (2006.01)
(Continued)

(52) U.S. Cl.
CPC ..... *A63B 21/4043* (2015.10); *A63B 21/023* (2013.01); *A63B 21/0608* (2013.01); (Continued)

(58) Field of Classification Search
CPC ..... A63B 21/0442; A63B 21/0552; A63B 21/1407; A63B 21/1415; A63B 21/1419; (Continued)

(56) References Cited

U.S. PATENT DOCUMENTS 2,496,748 A 2/1950 Pond
3,006,645 A 10/1961 Frazier
(Continued)

FOREIGN PATENT DOCUMENTS

JP 07017261 U 3/1995
KR 1020010026303 A 4/2001
WO 9412242 6/1994

*Primary Examiner* — Joshua Lee
(74) *Attorney, Agent, or Firm* — Klemchuk LLP; Kirby B. Drake

(57) ABSTRACT

An apparatus and method may exercise muscles of a body part, especially the neck, waist, torso, legs, and glutes from any angle with variable resistance while taking up minimal floor space. The apparatus may improve the ability of athletes, including football players and wrestlers, to better prepare for contact from any angle while engaged in their sport. The apparatus may include a ring having a guide track therein. Another inner ring may also be provided in different sizes and shapes to accommodate a variety of users. A car may be connected to a source of resistance ride freely along the guide track. The source of resistance may be other gym equipment including a bungee cord, a cable cross over machine, springs, and the like. As the user freely exercises by moving the body part, the car may adapt to the user's position to facilitate a full range of motion.

15 Claims, 8 Drawing Sheets

Related U.S. Application Data which is a continuation-in-part of application No. 13/252,004, filed on Oct. 3, 2011, now Pat. No. 9,555,283.

(51) Int. Cl.

| | |
|---|---|
| ***A63B 21/072*** | (2006.01) |
| ***A63B 23/025*** | (2006.01) |
| ***A63B 21/06*** | (2006.01) |
| *A63B 21/008* | (2006.01) |
| *A63B 23/00* | (2006.01) |
| *A63B 71/00* | (2006.01) |

(52) U.S. Cl.

CPC ..... *A63B 21/072* (2013.01); *A63B 21/4003* (2015.10); *A63B 21/4007* (2015.10); *A63B 21/4009* (2015.10); *A63B 21/4025* (2015.10); *A63B 21/4045* (2015.10); *A63B 23/025* (2013.01); *A63B 21/0088* (2013.01); *A63B 21/151* (2013.01); *A63B 2023/006* (2013.01); *A63B 2071/0063* (2013.01); *A63B 2225/09* (2013.01)

(58) Field of Classification Search

CPC ..... A63B 21/1484; A63B 21/1488; A63B 21/0407; A63B 21/0435; A63B 21/4003; A63B 21/4007; A63B 21/4009–21/4025; A63B 21/4045; A63B 21/4049; A63B 23/025; A63B 19/00–19/04; A63B 21/0608; A63B 22/20; A63B 22/208; A63B 2022/206; A63B 23/02; A63B 23/0482

USPC ..... 482/10, 43, 101, 105, 110, 114, 115, 482/121–130, 139, 904; 601/39; 119/770, 792, 795–798, 856, 857, 863; 446/236, 247; 182/36–38

See application file for complete search history.

(56) References Cited

U.S. PATENT DOCUMENTS

| | | | | |
|---|---|---|---|---|
| 3,532,340 | A | 10/1970 | Nardiello | |
| 3,721,216 | A | 3/1973 | Lippe et al. | |
| 3,866,910 | A | 2/1975 | Herring | |
| 4,052,982 | A | 10/1977 | Ozeryansky | |
| 4,111,415 | A | 9/1978 | Reitano | |
| 4,340,215 | A * | 7/1982 | Murphy | A61H 3/008 104/62 |
| 4,832,333 | A | 5/1989 | Lockett | |
| 5,080,045 | A | 1/1992 | Reese et al. | |
| 5,219,309 | A * | 6/1993 | Hart | A63B 67/00 441/131 |
| 5,509,869 | A | 4/1996 | Miller | |
| 5,709,637 | A | 1/1998 | Gow et al. | |
| 5,813,955 | A * | 9/1998 | Gutkowski | A63B 21/0004 482/121 |
| 5,984,836 | A | 11/1999 | Casali | |
| 6,106,437 | A | 8/2000 | Brooks | |
| 6,217,482 | B1 * | 4/2001 | Yoo | A63B 19/00 482/10 |
| 6,402,667 | B1 * | 6/2002 | Dahn | A63B 21/0087 482/121 |
| 6,440,047 | B1 | 8/2002 | Huang | |
| 6,592,536 | B1 | 7/2003 | Argenta | |
| 7,077,794 | B1 | 7/2006 | Bray | |
| 7,104,926 | B2 | 9/2006 | Carlson | |
| 7,232,357 | B2 * | 6/2007 | Chen | A63B 19/00 446/236 |
| 7,390,286 | B1 | 6/2008 | Edgeton | |
| 7,468,019 | B2 | 12/2008 | Zylstra | |
| 7,611,450 | B2 | 11/2009 | Mancini | |
| 2002/0100109 | A1 | 8/2002 | Hoop | |
| 2002/0177507 | A1 | 11/2002 | Carbone | |
| 2004/0033869 | A1 * | 2/2004 | Carlson | A63B 21/023 482/121 |
| 2006/0063652 | A1 | 3/2006 | Berman et al. | |
| 2008/0274858 | A1 | 11/2008 | Flavell et al. | |
| 2009/0062087 | A1 | 3/2009 | Poppinga | |
| 2010/0279830 | A1 | 11/2010 | Snagg | |
| 2010/0323861 | A1 | 12/2010 | Karwan | |
| 2011/0237400 | A1 * | 9/2011 | King | A61H 1/0274 482/8 |
| 2011/0294633 | A1 * | 12/2011 | Esrick | A63B 21/00069 482/139 |
| 2014/0342882 | A1 * | 11/2014 | Huang | A63B 21/22 482/110 |
| 2016/0035228 | A1 * | 2/2016 | Cakmak | A61H 3/008 434/247 |
| 2017/0100620 | A1 * | 4/2017 | Hsiao | A63B 19/00 |

* cited by examiner

FIG. 1
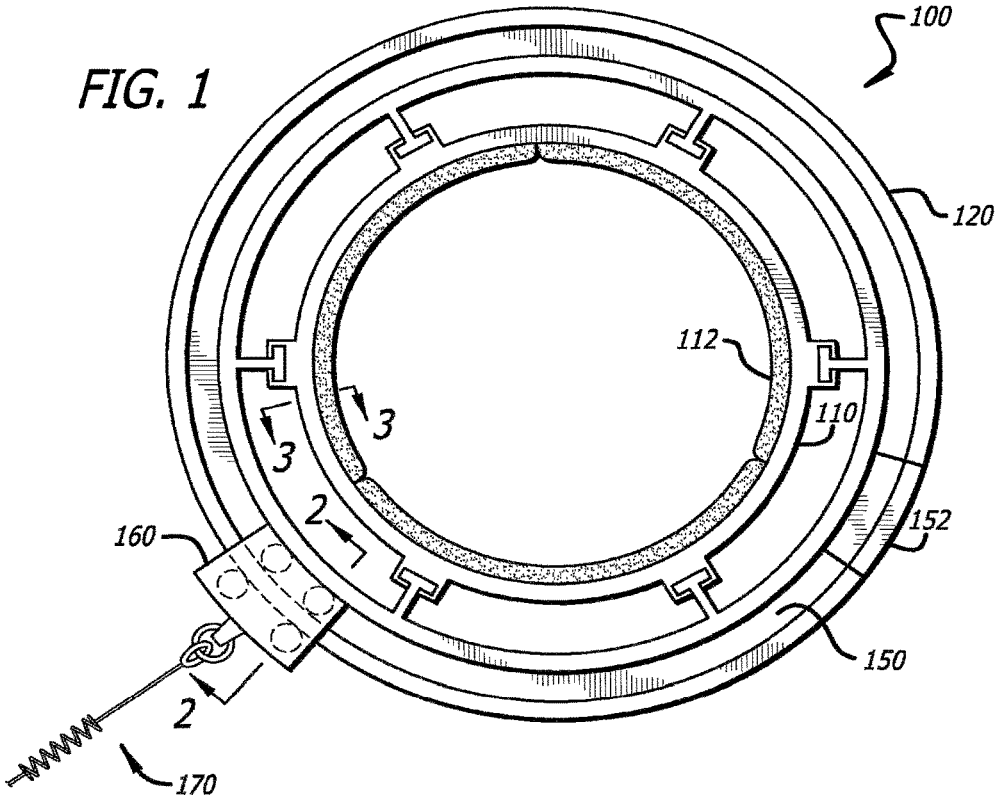
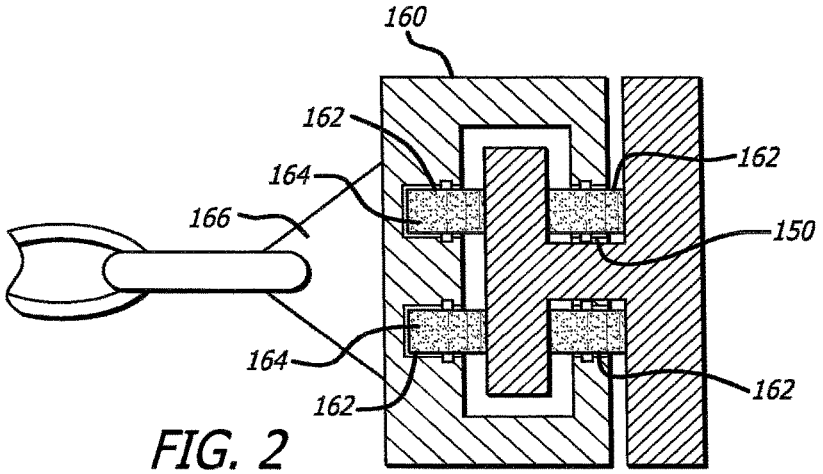
FIG. 2

FIG. 9
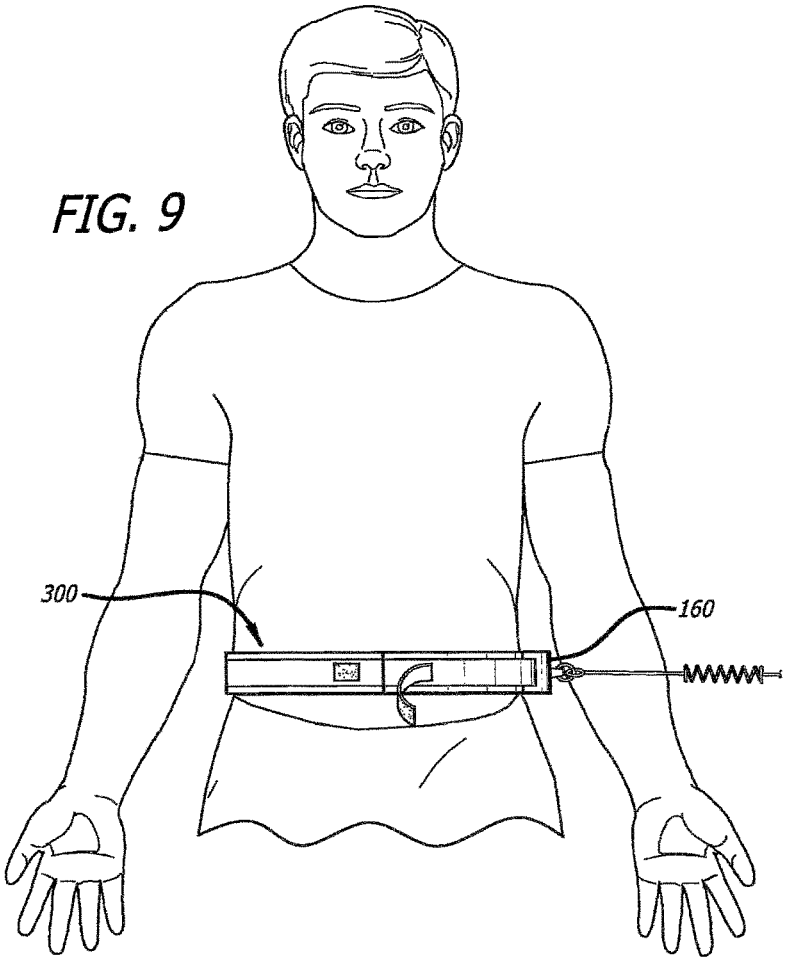
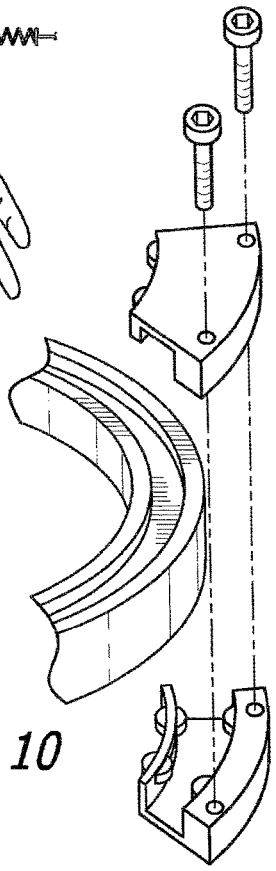
FIG. 10

EXERCISE RING FOR IMPROVING STRENGTH AND FLEXIBILITY OF A BODY PART

CROSS-REFERENCE TO RELATED APPLICATIONS

This application is a continuation-in-part of U.S. application Ser. No. 13/252,004 filed Oct. 3, 2011, entitled "EXERCISE RING FOR IMPROVING STRENGTH AND FLEXIBILITY OF A BODY PART," and a continuation-in-part of U.S. application Ser. No. 13/457,371 filed Apr. 26, 2012, entitled "EXERCISE RING FOR IMPROVING STRENGTH AND FLEXIBILITY OF A BODY PART," both of which are incorporated herein by reference in their entirety.

FIELD OF THE DISCLOSURE

The present disclosure is generally directed to apparatuses and methods for exercising the human body to improve agility, balance, coordination, flexibility, and strength. One application is particularly directed to an apparatus and a method for exercising the human neck and related muscles. Other applications are directed to an apparatus and a method for exercising the chest, the waist, the oblique side muscles, the torso, the legs, the gluteus maximus or glutes, and almost any other body part from any angle with variable resistance while taking up minimal floor space.

BACKGROUND

Traditional gym equipment for exercising, and available equipment for exercising the neck, legs, and gluteus maximus, in particular, takes up a large amount of floor space which can be very valuable in a gym environment. Gym space must be bought or leased and more space taken up by one piece of equipment limits the number of other pieces of equipment that may fit into the gym. The total amount of equipment available in turn limits the number of people that can comfortably workout at the same time and this can influence the optimal number of memberships sold. Equipment that takes up little floor space provides advantages of being able to fit more equipment into the gym so that more people can workout simultaneously and more memberships may be sold, increasing revenues for the fitness club.

Most gyms offer some form of group exercise classes which tend to be particularly popular to keep people motivated. New varieties of group exercise classes are continually emerging in an effort to keep exercise fun and interesting. Some types of group exercise classes provide some equipment with which the individual class members each work with independently while following a class instructor. For example, there are aerobic step classes in which each member has a step to work with and other strength training classes in which each member has a set of weights. For group classes incorporating some work with gym equipment, given the potentially large number of attendees or class members, it is desirable to have reasonably priced equipment for class members to use that provides a myriad of exercise possibilities so that the class instructor can be creative and provide an effective workout.

Traditional gym machines for exercising the neck, legs, gluteus maximus, and other body parts are not ideal because they only workout the body part at limited angles with a limited range of motion. In many sports, especially contact sports like football, athletes may be subjected to force from any angle. Accordingly, exercise machines that only exercise the neck, legs, gluteus maximus, or other body parts at limited angles do not adequately prepare and protect the athlete for the often unpredictable environment to which they are subjected on the playing field.

The cervical spine and muscles of the neck of the human body are extremely complex, such that the movement of the head with respect to the body requires an integrated movement of many muscles in coordination with the articulation of the cervical spine. As such, many people suffer from conditions resulting from improper orientation of the cervical spine, imbalance of the posterior cervical muscles and compression of the spine. These conditions may result from faulty or sustained postures, trauma, emotional stress and the like.

Indeed, many people exhibit a variety of discomforts caused by the misalignment of the cervical spine and imbalance of the associated muscles. For example, localized pain, headaches, decreased circulation and soreness, to name a few, decrease the quality of life of persons suffering from these conditions. These conditions have an associated cycle of pain and muscle contraction that leads to decreased function and potential soft tissue dysfunction.

The most common way to attempt to alleviate this pain is with medication. Another way to alleviate pain in this area is by strengthening and stretching the muscles in or around the head, neck, and shoulders. More specifically, the group of muscles targeted includes longissimus capitis, suboccipital, emispmalis capitis, longissimus cervicis and levator scapula. Free weights, dumbbells, and exercise/weight machines are known for building and training various muscles in the body. Despite the wide variety of exercise strengthening devices, neck muscle strengthening devices for strengthening the core muscles of the neck are not well known or widely used.

At some gyms the available floor equipment for exercising the legs and gluteus maximus is crowded and quickly filled. It is counterproductive to the goal of staying in motion to stand around waiting for desired equipment to become available.

It would be desirable to provide an apparatus for exercising the legs and gluteus maximus that an exerciser can use in an open space, empty studio, or at home, instead of waiting for gym floor equipment to become available, and that provides a greater number of possibilities for exercising the muscles from new angles to keep muscles continually challenged.

It would be desirable to provide an easy to use apparatus for strengthening and stretching the muscles of the head, neck, spine, shoulder, upper back, torso, legs, gluteus maximus, and others at any angle with variable resistance and variable size settings to accommodate a variety of users that takes up minimal space on a gym floor. It would also be desirable to provide a size-adjustable apparatus that takes up minimal floor space and can be interchangeably engaged with various sources of resistance for exercising a selected body part at any angle, including the chest, back, oblique side muscles, torso, abdominals, arms, legs, gluteus maximus, and any other body part.

SUMMARY

According to a first aspect, the present disclosure provides an apparatus for strengthening and stretching the muscles of the neck and related muscle groups at any angle or at several angles. The apparatus is designed to accommodate a variety of users of different sizes. The apparatus includes two rings, an outer halo ring and an inner head ring, the latter configured to fit around a user's head at the forehead level. The inner head ring is provided in a variety of different sizes to accommodate a variety of users having heads of different sizes. The outer halo ring fits around the inner head ring and has a guide track along an outer surface thereof. The guide track around the outer periphery of the outer halo ring is configured to accommodate a car riding along the guide track in a substantially circular motion around the user's forehead thereby enabling the user to move freely to exercise the neck from any angle and from several different angles.

The guide track on the outer halo ring may include a protrusion or a groove that complements a corresponding structure on the car. A section of the outer halo ring may be removable in order to initially mount the car onto the outer halo ring, and to remove the car from the outer halo ring. The car has a first end with a structure that may include wheels or another mechanism for moving (e.g. rolling, gliding, and the like) along the guide track on the outer halo ring. At a second end of the car opposite to the first end having structure that rides along the guide track is a different structure configured for attachment of the car to a source of resistance. For example, the different structure at the second end for attachment to a source of resistance may simply be a hole through which a source of resistance can be hooked, looped, or otherwise attached. The structure that provides resistance may include a bungee cord, a kettle bell, an adjustable cable cross over machine, springs of different tensions, a cable attached to a weight machine, weighted exercise balls, a parachute or other device that utilizes wind resistance, or simply a wall or columnar structure.

The inner head ring attaches to the outer halo ring through a plurality of releasable attachment ports around the inner and outer rings. In this manner, a user may select the appropriate head ring to use based on the size of his/her head and then insert this fitted inner head ring into the uniform outer halo ring before beginning to exercise.

In addition to serving the needs of football players, wrestlers, and other athletes, embodiments of the present disclosure may also find utility for the average individual seeking to stretch and strengthen the neck in order to reduce or minimize neck and upper back pain caused from everyday stress, tension, poor posture, problematic sleeping positions, and the like.

According to a second aspect, the present disclosure provides an apparatus for strengthening and stretching the muscles of other body parts at any angle or at several angles, including, but not limited to, the chest or pectorals, the back, the oblique muscles of the side, the abdominals, the buttocks, the legs, the arms, and any other body part. This is accomplished by adapting the basic structure discussed above for the neck to another body part. The main feature is a ring configured to securely fit around a body part, the ring having a guide track on an outer surface thereof configured to accommodate a moving car that connects the ring to a source of resistance. When appropriate, a first inner body part ring may be provided in different sizes to fit around a body part and to fit inside a second uniform outer ring having a guide track around an outer periphery. In other cases, depending on the body part being exercised, it may be more appropriate to just have a single ring, which may be adjustable in size, that fits around the body part and has a guide track around its outer periphery.

Embodiments of the present disclosure may be ideal for individuals and commercial gyms seeking to maximize the value of their equipment, machines, weights, springs and other resistance sources by purchasing adjustable interchangeable pieces and systems that can work together. The various embodiments of the present disclosure are also for those seeking to minimize the use of floor space as the basic apparatus of the present disclosure can be used with existing sources of resistance.

According to a first aspect of the present disclosure, an apparatus for exercising a user's neck is provided including a headpiece element configured to be worn in a head region of a user, the headpiece element having a guide track therein. The apparatus also includes a car having an attachment port for connection to a source of resistance, the car configured to fit within the guide track of the headpiece element and to move along the guide track. The attachment port may be fixed for connection to a source of resistance. As a user freely moves a neck or a head at any angle, the car adjusts its positioning along the guide track while maintaining a substantially stable position of the attachment port relative to the source of resistance, thereby enhancing a user's range of motion and comfort during exercise. The headpiece element of the apparatus may comprise a first ring configured to fit around a user's forehead. The first ring may leave a top of a user's head uncovered. The headpiece element may also include a second ring having a diameter larger than the first ring, the second ring configured for positioning outside of the first ring, the second ring having a structure along an inner perimeter for attaching to a corresponding structure along an outer perimeter of the first ring. The guide track of the headpiece element may be in the second ring. The guide track of the headpiece element may be along an outer perimeter of the second ring. The guide track may be stationary according to an embodiment of the present disclosure. The structure of the second ring for attaching to the corresponding structure of the first ring may include at least one protrusion and the corresponding structure of the first ring may include at least one groove configured to receive and mate with the protrusion. The structure of the second ring for attaching to the corresponding structure of the first ring may include at least one groove configured to receive and mate with the corresponding structure of at least one protrusion on the first ring. The structure of the second ring for attaching to the corresponding structure of the first ring may include a material available under the Velcro trademark and the corresponding structure of the first ring may include a mating strip of material available under the Velcro trademark. The structure of the second ring for attaching to the corresponding structure of the first ring may include a strip of a first material that adheres to another strip of a second material included in the corresponding structure of the first ring. The apparatus may also include a locking mechanism to secure the second ring to the first ring. The first ring may be available in a plurality of shapes or sizes, each first ring of the plurality configured to engage with the second ring. The car of the apparatus may have a wheel for moving along the guide track. The car of the apparatus may have a guide element having a lubricious surface for moving along the guide track. A section of the guide track of the apparatus may be removable for loading or unloading the car. The car may be configured to open up for receiving the guide track or for disengaging from the guide track during loading or unloading of the car. The first ring of the apparatus may have foam padding along an inner perimeter thereof, the foam padding configured to provide comfort when resting against a user's forehead. The first ring may also have a protective material covering the foam padding. The protective covering may be, for example, an artificial leather or "pleather" such as that available under the trademark Naugahyde for a composite of a knit fabric backing and a polyvinyl chloride (PVC) plastic coating. The apparatus may also include a source of resistance. The source of resistance for the apparatus may be selected from the following group: a bungee cord, a kettlebell, a spring under tension, a cable cross over machine, a Pilates machine, a weight stack, a weighted exercise ball, a pillar, a column, a hook on a wall, and a parachute.

According to a second aspect of the present disclosure, a method of exercising the neck is provided including selecting a first head ring of an appropriate shape and size to securely fit a user's head, engaging the first head ring with a second ring, the second ring having a larger diameter than the first head ring and being outside the first head ring, and moving a head or a neck of a user at any angle, whereby the second ring is flexibly attached to a source of resistance through an adjustable connection such that as a user freely moves the adjustable connection responds to provide comfort and enhanced range of motion for a user. An attachment port may fit and move around a guide track. The guide track of the headpiece element may be in the second ring. The guide track of the headpiece element may be along an outer perimeter of the second ring. The guide track may be stationary according to an embodiment of the present disclosure.

According to a third aspect of the present disclosure, an apparatus for exercising a body part is provided including a first ring configured to be worn around a body part of a user, the first ring having a guide track therein and a car having an attachment port for connection to a source of resistance, the car configured to fit within the guide track of the first ring and to move along the guide track. As a user freely moves a body part at any angle, the car adjusts its positioning along the guide track while maintaining a substantially stable position of the attachment port relative to the source of resistance, thereby enhancing a user's range of motion and comfort during exercise. The guide track may be stationary according to an embodiment of the present disclosure. The apparatus may also include a harness configured to be worn by a user, the harness having a plurality of structures along an outer perimeter thereof for attaching to a corresponding plurality of structures along an inner perimeter of the first ring. The apparatus may also include a harness configured to be worn by a user and a second ring received by the harness, the second ring having a plurality of structures along an outer perimeter thereof for attaching to a corresponding plurality of structures along an inner perimeter of the first ring. The attachment port may fit between the guide track and the second ring and may move around the guide track for connection to a source of resistance.

Other features and advantages of the present disclosure will become apparent from the following detailed description, taken in conjunction with the accompanying drawings, which illustrate, by way of example, the principles of the present disclosure.

BRIEF DESCRIPTION OF THE DRAWINGS

FIG. 1 is a downward view of a headpiece element showing the inner head ring inside the outer halo ring according to an embodiment of the present disclosure.

FIG. 2 is a side view of a car received in the guide track according to an embodiment of the present disclosure.

FIG. 9 is a frontal view of an individual wearing an exercise apparatus incorporating a belt, for exercising other body parts including the legs and buttocks, around his waist with the apparatus connected to a source of resistance according to an embodiment of the present disclosure.

FIG. 10 is a perspective view of the car opening up to receive or disengage from the guide track during loading or unloading according to an embodiment of the present disclosure.

DETAILED DESCRIPTION

Provided herein is an apparatus for strengthening and stretching muscles from any angle while taking up minimal floor space at a fitness club or home gym. The apparatus is adaptable for integration with other gym equipment including cable cross over machines, weight stacks, springs, Pilates machines, weighted exercise balls, parachutes that take advantage of wind resistance, bungee cords, kettle bells, and the like through an attachment port on a car that rides freely along an outside perimeter of the apparatus.

Figure 5:
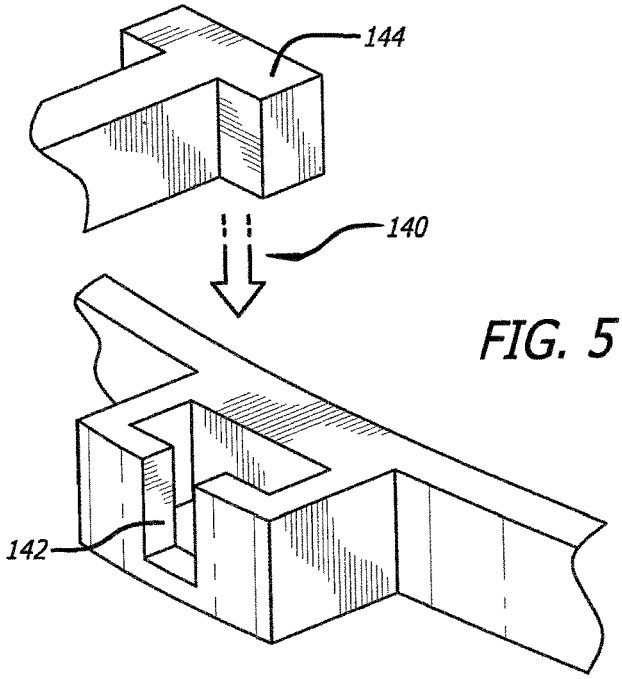
FIG. 5 is a perspective view of an inner ring engaging with the outer ring according to an embodiment of the present disclosure.
Figure 6:
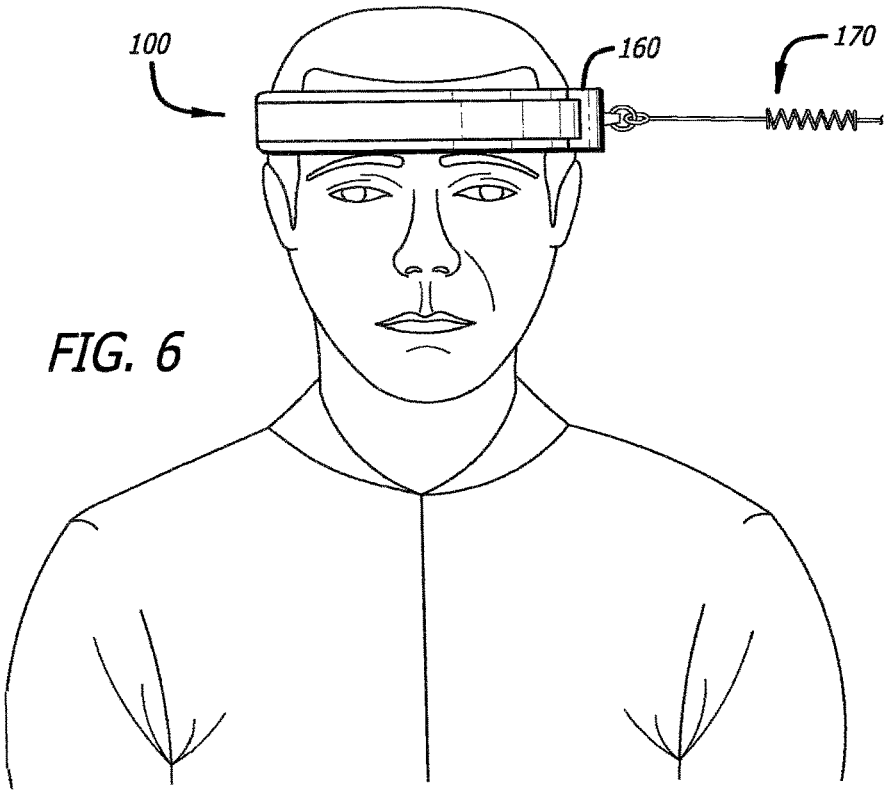
FIG. 6 is a frontal view of an individual wearing an exercise apparatus for exercising the neck on his forehead with the apparatus connected to a source of resistance according to an embodiment of the present disclosure.

According to a first aspect of the present disclosure, the apparatus is configured for strengthening and stretching the neck and related muscle groups at any angle or at several angles. In this embodiment the apparatus includes headpiece element 100 made up of inner head ring 110 and outer halo ring 120. Headpiece element 100 may be made out of any material including, but not limited to, metal, wood, and a variety of different composite materials that may be utilized in an injection mold. Inner head ring 110, 180 is provided in different shapes and sizes and can be engaged with outer halo ring 120 though a releasable locking mechanism 140. Inner head ring 110 may engage with outer halo ring 120 through a plurality of attachment ports. The attachment ports comprise structures 144 on an inner perimeter of the outer halo ring that mate with corresponding structures 142 on an outer perimeter of the inner head ring. These structures of the outer halo ring and corresponding structures of the inner head ring may include structures 114, which may be uniquely shaped protrusions and corresponding structures 142, which may be grooves, to fit the protrusions as shown in FIG. 5, or buttons that snap into position, or clips, or mating strips of materials that adhere to each other, or Velcro (trademark) strips, or the like. That is, the structure of the outer ring and the corresponding structure of the inner ring that secure the rings together may be a fastening system including two strips of nylon fabric, one having tiny hooked threads and the other a coarse surface, that form a strong bond when pressed together.

Figure 8:
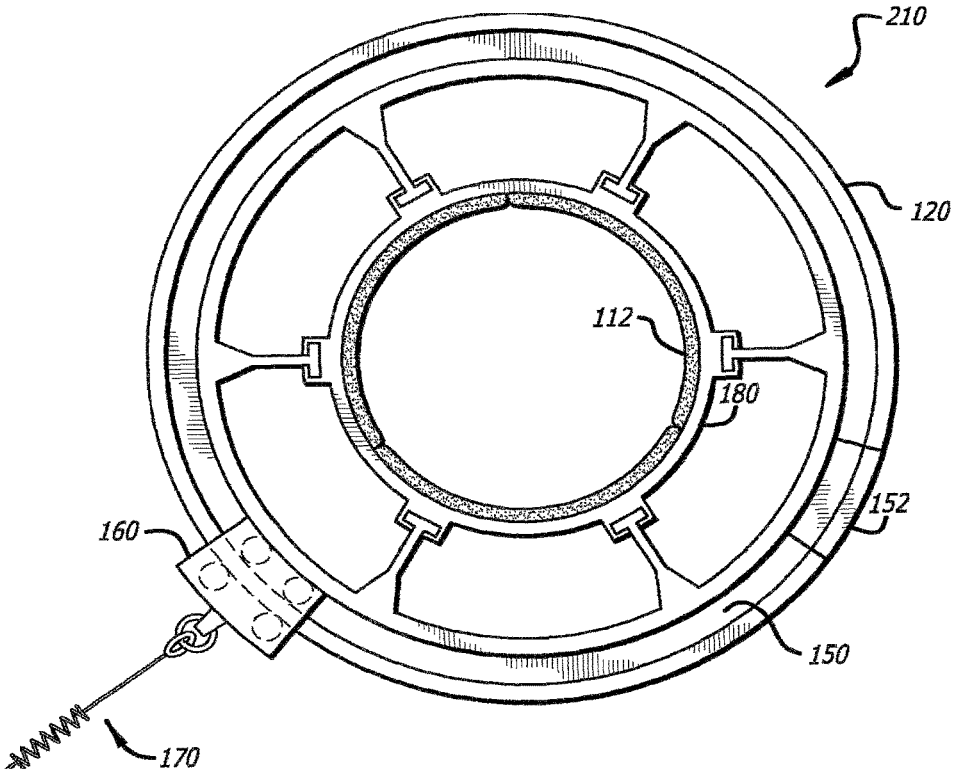
FIG. 8 is a downward view, similar to FIG. 1, showing a smaller sized inner head ring illustrating that the inner ring may come in a variety of sizes according to an embodiment of the present disclosure.
Figure 11:
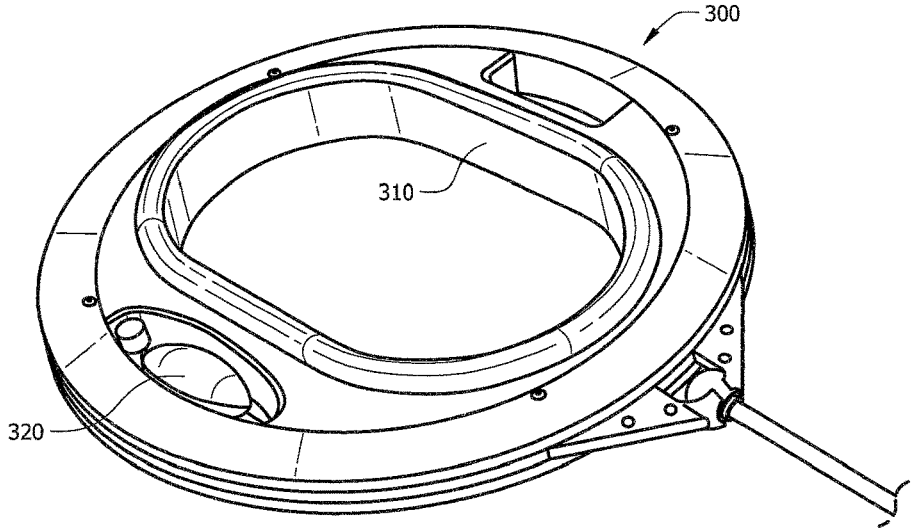
FIG. 11 is a perspective view of a waist piece element according to an embodiment of the present disclosure.
Figure 12:
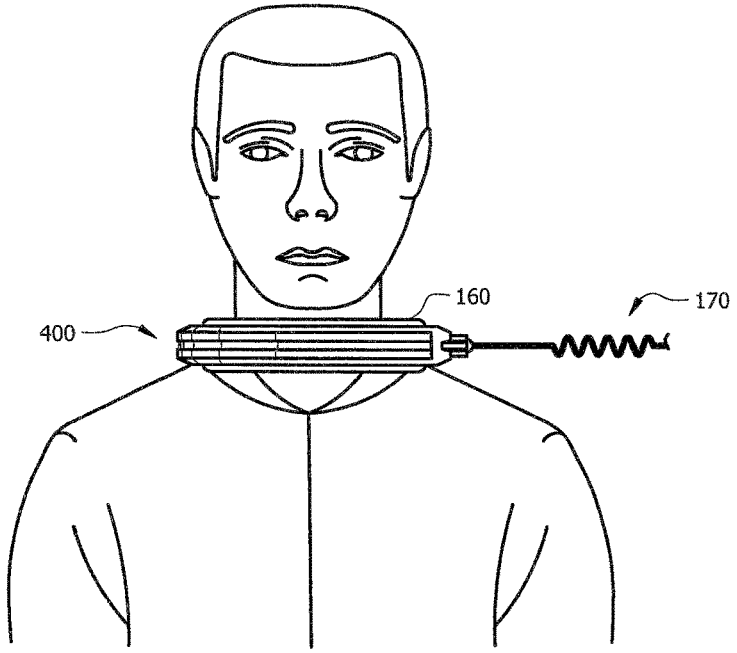
FIG. 12 is a frontal view of an individual wearing an exercise apparatus for exercising the neck on his neck with the apparatus connected to a source of resistance according to an embodiment of the present disclosure.
Figure 13:
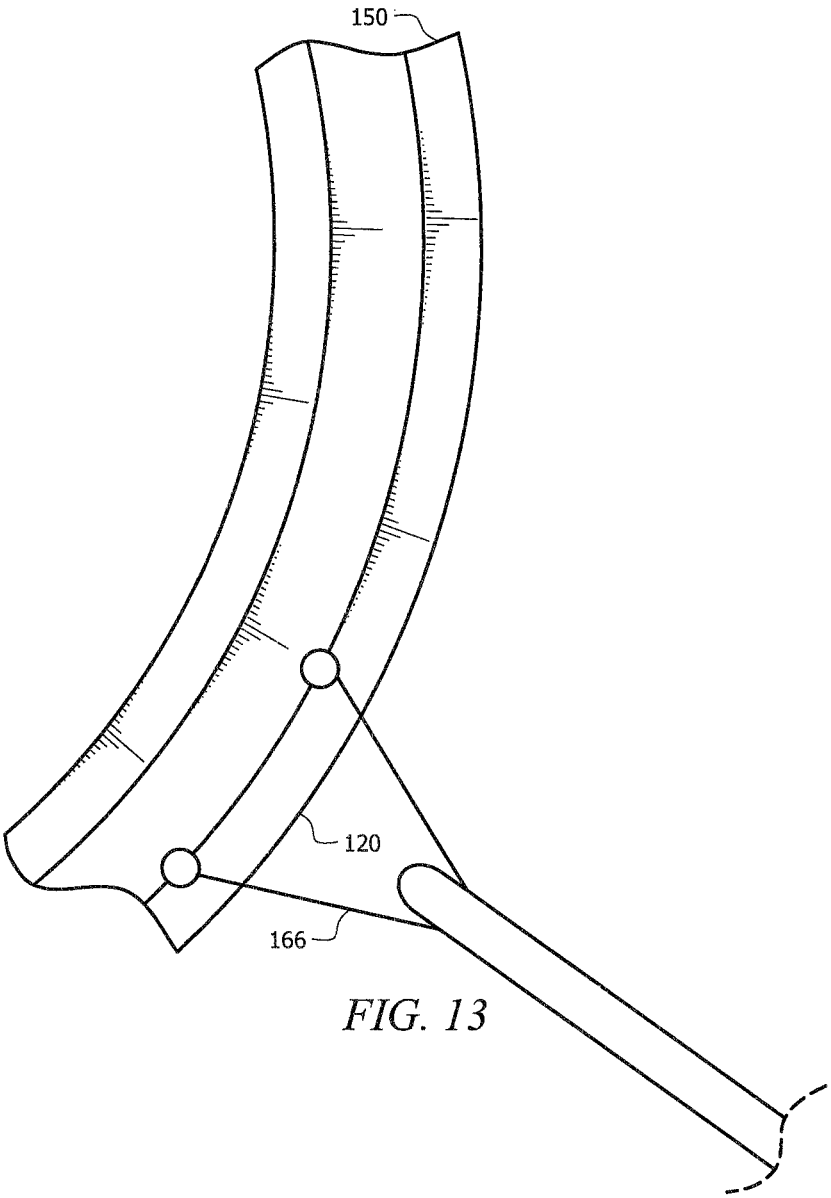
FIG. 13 is a downward view a guide track to load or unload the car according to an embodiment of the present disclosure.

The inner head ring may be provided in a variety of sizes and still fit within a uniform outer halo ring by any number of feasible structural adaptations for changing the manner in which the inner ring and outer ring fit together as the size of the inner ring varies. Comparing headpiece elements 100, 210 of FIG. 1 with FIG. 8 illustrates how inner head rings 110, 180 of different sizes may be accommodated within the same outer ring 120. Headpiece element 100 of FIG. 1 shows inner head ring 110 of a first size while headpiece element 210 of FIG. 8 shows inner head ring 180 of a second smaller size. For example, as shown in FIG. 8, the protrusions extending inward from the outer ring to meet and lock up with corresponding grooves along smaller inner ring 180 are longer than they are in FIG. 1 to meet and lock up with larger inner ring 110. The protrusions may be telescopically extendable and retractable to define a circumference of the appropriate size to fit the selected inner ring. Another option for reducing the size of the inner ring to fit a smaller head is to increase the amount of foam padding along the inner perimeter of the inner ring. Alternatively, the inner ring and outer ring may be secured to each other through mating strips having surface texture and/or made of a material such that the strips adhere to each other, for example strips available under the trademark name Velcro, among other possibilities.

According to one embodiment, outer halo ring 120 has a plurality of T-shaped protrusions 144 that fit into corresponding T-shape grooves or indentations 142 on inner head ring 110, 180. The attachment ports between the inner head ring and the outer halo ring may be equally spaced from each other around the perimeter of the rings but need not be. According to one embodiment there are six attachment ports equally spaced around the perimeter of the rings. Attachment ports may be configured to fit between guide track 150 of outer ring 120. Guide track 150 may be formed by a top portion and a bottom portion of outer ring 120 that may be attached to one another. It should be appreciated that a car attachment may fit around guide track 150 of outer ring 120 and may move along the guide track 150. Attachment port 166 may be provided on the car attachment and may connect to a source of resistance.

For user comfort, the inner head ring that fits around a user's head at the level of the forehead may include padding 112 covered with protective material 114 that is easy to clean, improves durability, and protects the padding. For example, an artificial leather or "pleather" is one example of a suitable cover material outside the foam padding. It should be appreciated that padding 112 may be made in the form of bladder 310 that may be blown up with air. It should further be appreciated that bladder 310 may be provided on any portion of padding 112. It should also be appreciated that padding 112 may be made of foam, plastic, or another material. It should be appreciated that a front piece for a forehead of a user and a back piece for a back of a head of a user may be provided. The inner head ring may be rigid or may be semi-flexible to better conform to the shape of a user's head. The inner head ring may be provided in slightly different shapes to better correspond to the actual shapes of different users' heads. For example, some people may have heads with substantially circular cross-sections while other people have heads with substantially oval or elliptical cross-sections.

Either the inner head ring or the outer halo ring or both may also include one or more straps over the head, closely corresponding to the shape of the head to provide added stability in securing the headpiece apparatus on the head of a user during exercise. According to one embodiment, the inner head ring is provided with two straps that cross each other at a ninety degree angle such that one strap runs from ear to ear of the user and the other strap runs from a front center of a user's head to a back center of a user's head when the inner head ring is correctly positioned on the head of a user. According to another embodiment, straps may be vertical adjustment straps that may include markings that may denote vertical placement of headpiece element 100 on a user's head. It should be appreciated that straps may not include markings without departing from the present disclosure. Straps may be positioned as a chin strap and/or a neck strap. It should be appreciated that any of straps may be attached to headpiece element 100 by utilizing a two-point, four-point, and/or a six-point attachment system. It should be appreciated that an attachment system may include attachment mechanisms including, but not limited to, snaps, rivets, screws, and/or looped through two slits and sewn together. It should be appreciated that a chin strap and/or a neck strap may not be included in the inner head ring without departing from the present disclosure.

Neckpiece element 400 may closely correspond to the shape of the neck of a user to provide stability in securing the neckpiece apparatus on the neck of the user during exercise. It should further be appreciated that straps may be attached to neckpiece element 400 by utilizing a two-point, four-point, and/or a six-point attachment system.

The outer halo ring includes a channel along an outer perimeter thereof that serves as guide track 150 for car 160 that connects the assembly of rings to source of resistance 170 through attachment port 166 on the car, as shown in FIG. 2. Source of resistance 170 may connect to the assembly of rings in car 160 and may not connect to guide track 150. According to one embodiment, the attachment port is simply a hole on an end of the car, opposite the end of the car that engages the guide track, configured to fit a hook or loop extending from a connector that attaches to a source of resistance. It should be appreciated that attachment port 166 may not be provided on the car in embodiments of the present disclosure.

Figure 3:
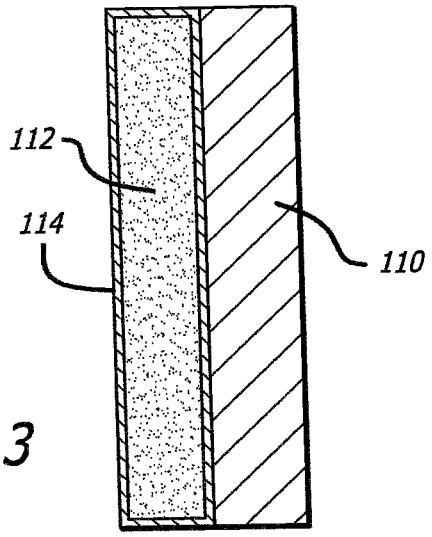
FIG. 3 is a side view of foam padding covered with a protective material along an inner surface of the head ring according to an embodiment of the present disclosure.
Figure 4:
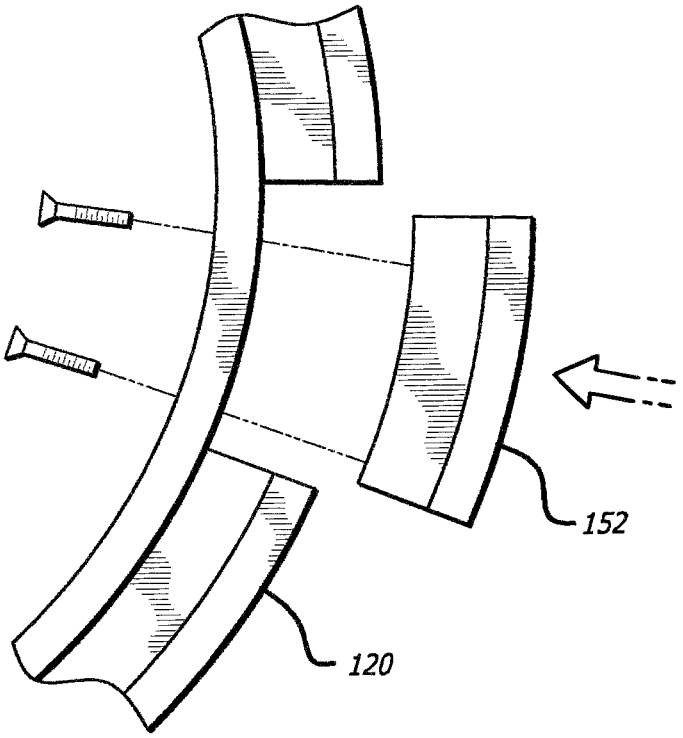
FIG. 4 is a downward view of a portion of the guide track removed to load or unload the car according to an embodiment of the present disclosure.

The car may include one or more wheels 162 or other guide elements received by guide track 150 of outer ring 120 for moving along it. The wheels or other guide elements may have lubricious surface 164 by being coated with or otherwise formed from a special low-friction material to facilitate the ability of the car to move easily along the guide track. Inner ring 110 may be fixed in place and outer ring 120 may slide on wheel 162 or wheel bearings around inner ring 110. Attachment port 166 may be fixed on the outside of outer ring 120 and may provide a connection to a source of resistance. A section 152 of the guide track may be removable for loading and unloading of the car, as shown in FIG. 4. It should be appreciated that the guide track may be stationary without departing from the present disclosure. Alternatively, as shown in FIG. 10, the car may open up or split in half, completely separating into two or more pieces or opening like a mouth about a pivot axis for loading and unloading onto a fixed or integrally formed track. According to another embodiment, guide track 150 may be stationary and may not open. It should be appreciated that guide track 150 may not include a removable section or removable sections without departing from the present disclosure.

According to a second aspect of the present disclosure, the apparatus is configured for strengthening and stretching the muscles of another body part at any angle or at several different angles. The exact structure of the embodiment will depend upon the body part desired to be exercised. A unifying principle feature across the various embodiments is a ring configured to fit around a body part having a guide track extending around the ring's outer periphery along which a car connected to a resistance source smoothly rides and adjusts as the user freely moves about.

In some embodiments of the second aspect, the assembly of an inner body part ring provided in a variety of sizes and slightly different shapes and an outer ring with the track may be provided as discussed above for the neck application. In other embodiments a single ring may be provided that fits around the body part and has a guide track built into it around its outer periphery.

Figure 7:
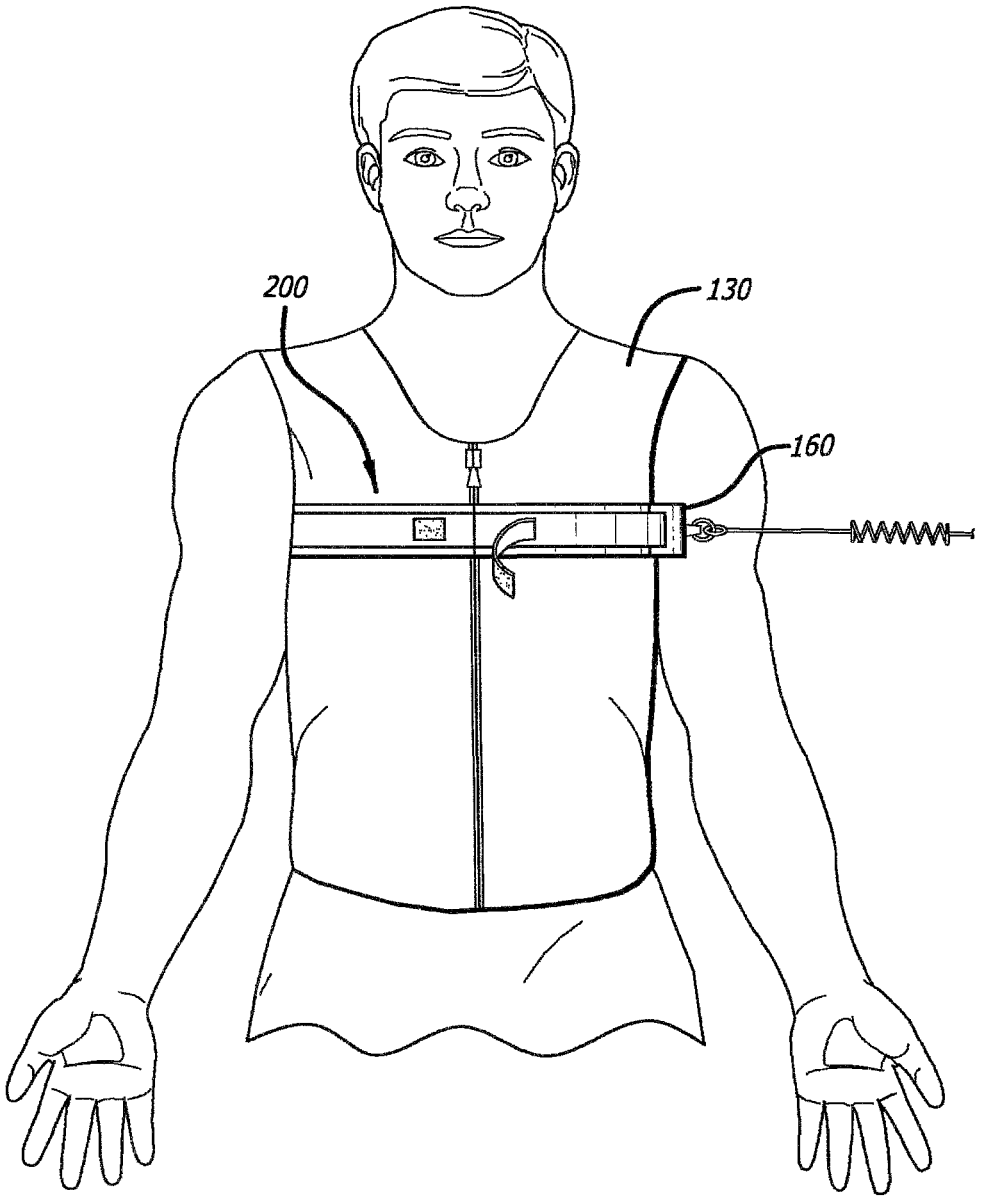
FIG. 7 is a frontal view of an individual wearing an exercise apparatus of the incorporating a harness, for exercising other body parts, around his chest with the apparatus connected to a source of resistance according to an embodiment of the present disclosure.

As shown in FIG. 7, one specific embodiment in accordance with the second aspect of the present disclosure is to provide a means to exercise the body through a chest piece element 200 including a ring or a band placed around the chest. The assembly of outer ring and inner ring may be provided or a single ring may be provided for this embodiment. According to one embodiment, a variation of the ring assembly is provided in which the inner ring is instead harness 130 or a vest that the user wears. In this embodiment, the harness or vest would have structures thereon for engaging with corresponding structures on the outer ring. According to another embodiment, the inner ring is on a harness or vest the user wears but is not itself a harness or vest. According to another embodiment, a single ring is provided having a guide track thereon for wearing around the chest. In any of these embodiments, the harness or inner ring may be made adjustable to fit different users. The harness or inner ring may incorporate Velcro (trademark) material, webbing, or similar materials and designs for adjustability.

The embodiments including a ring or assembly of rings around the chest region with or without a harness or vest will find application, for example, for football players on a field doing training drills. With this embodiment, the unpredictable experiences encountered on a field may be simulated by attaching the car riding along a guide track of the ring to a source of resistance. The resistance pulling backwards against the weight of the user simulates other players holding the user back as the user tries to run. The guide track and car assembly provided by the present disclosure enable the user to freely maneuver at any angle in attempt to break away from real or imagined obstacles. For example, the user may twist from side to side, tum, gallop, sashay, run, etc. with the source of resistance pulling back for added challenge. Using a parachute as the source of resistance would be suitable for this application. By wearing the ring having a guide track upon which a car is mounted the user is able to run and even spin or tum in circles without the connection to the source of resistance getting tangled because the car riding around along the guide track simply changes position as necessary to compensate and counter balance the user's movement to maintain a relatively stable position and angle of the car relative to the connector and to the source of resistance. That is, the car moves relative to the guide track but remains in approximately the same position relative to the source of resistance and the connector between the car and the source of resistance.

As shown in FIG. 9, another specific embodiment in accordance with the second aspect of the present disclosure is to provide a means to exercise the body, especially the various muscles of the legs and the gluteus maximus muscles of the buttocks, through waist piece element 300 including a ring or a band placed around the waist. The assembly of outer ring and inner ring may be provided or a single ring may be provided for this embodiment. According to one embodiment, a variation of the ring assembly is provided in which the inner ring is instead a waistband or belt the user wears. In this embodiment, the waistband or belt would have structures thereon for engaging with corresponding structures on the outer ring. According to another embodiment, the inner ring is on a waistband or belt the user wears but is not itself a waistband or belt. According to another embodiment, a single ring is provided having a guide track thereon for wearing around the waist. According to another embodiment, padding 112 may be made in the form of bladder 310 that may be blown up with air. It should be appreciated that bladder 310 may be provided on any portion of padding 112. It should further be appreciated that bladder 310 may be provided only along a rear portion of padding 112, only along a front portion of padding 112, only along a side(s) portion of padding 112, along any combination of a rear, front, and/or side portions of padding 112, and/or may completely encircle a body part (i.e., a user head, a user neck, a user waist, etc.) of a user when bladder 310 is in use. It should be appreciated that padding 112 that may be provided along a side(s) of a head of a user may be made of foam. Waist piece element 300 may include bladder 310 that may secure waist piece element 300 around the waist of a user by expanding with air and may capture the user's body. According to another embodiment, pump 320 may blow bladder 310 up with air. Pump 320 may be positioned proximate an outer edge or outer diameter of waist piece element 300. According to another embodiment, pump 320 may be recessed in waist piece element 300 and/or in headpiece element 100. According to another embodiment, pump 320 may be exposed in waist piece element 300 and/or in headpiece element 100. In any of these embodiments, the waistband, belt, or inner ring may be made adjustable to fit different users. The waistband, belt, or inner ring may incorporate Velcro (trademark) material, webbing, or similar materials and designs for adjustability.

The embodiments including a ring or assembly of rings around the waist region with or without a waistband or belt will find application, for example, in group exercise classes including group aerobics. With this embodiment, several individuals and a group exercise class instructor may each wear the exercise belt around the waist with the car on the ring or outer ring attached to a bungee cord and the bungee cord held to a wall or other heavy, stable structure. A resistive band may be provided that may connect to an attachment that may be provided by car 160 and may not connect to guide track 150. The bungee cord and wall or column provide the needed resistance for stretching and strengthening muscles. A breaking mechanism may be provided that may create a locational resistance that may strengthen muscles. A breaking mechanism may built into the car and may cause friction along a guide path that may slow down or prevent rotation of the car along the guide path. The class instructor can lead the class members through a series of moves that include twisting, turning, moving forward, moving backward, moving from side to side, squatting, lunging, leaping, pivoting, etc. and each exerciser will be able to move freely on account of the mobile car secured to the guide track on the ring, outer ring, exercise belt, or waistband.

The apparatus in accordance with the present disclosure may be configured for use with a source of resistance that may include any one or more of the following: a bungee cord, a kettle bell, a cable cross over machine, a Pilates machine, weight stacks, a wall, a column, a parachute, and the like.

According to another application of the apparatus in accordance with an embodiment the present disclosure, the source of resistance is a kettle bell to provide extreme conditioning. With the individual standing substantially stationary, the body part with the ring around it may be gyrated or whirled in a substantially circular motion or pivoted from side to side to move the kettle bell on the floor through the mobile car mounted on the ring.

The present disclosure is not limited to the embodiments described above. Various changes and modifications can, of course, be made, without departing from the scope and spirit of the present disclosure. Additional advantages and modifications will readily occur to those skilled in the art. Accordingly, various modifications may be made without departing from the spirit or scope of the general inventive concept as defined by the appended claims and their equivalents.

What is claimed is:

1. An apparatus for exercising a user's neck, comprising:

a car having a first end configured to move the car using wheels or guide elements and a second end opposite the first end having a fixed attachment port for connection to a source of resistance; and a stationary guide track configured to provide loading and unloading of the car, the car configured to fit within the stationary guide track of a headpiece element and to move along the stationary guide track, whereby as the user freely moves the neck or a head at any angle, the car adjusts its positioning along the stationary guide track while maintaining a substantially stable position of the attachment port relative to the source of resistance, thereby enhancing the user's range of motion and comfort during exercise, wherein the car includes two or more separable pieces configured to open about a pivot axis for loading and unloading about the stationary guide track, wherein a first separable piece is configured to move along an outer periphery of the apparatus, and wherein a second separable piece is configured to move along an inner periphery of the apparatus.

2. The apparatus of claim 1, wherein the headpiece element comprises a first ring configured to fit around a forehead of the user, the first ring selected from a plurality of first rings having different shapes and sizes.

3. The apparatus of claim 2, wherein the apparatus leaves a top of the user's head partially uncovered.

4. The apparatus of claim 2, the headpiece element further comprising:

a second ring having a diameter larger than the first ring, the second ring configured for positioning outside of the first ring, the second ring having a structure along an inner perimeter for attaching to a corresponding structure along an outer perimeter of the first ring, wherein the stationary guide track of the headpiece element is in the second ring, wherein the first ring and the second ring are detachable, and wherein the second ring is configured to mate and attach to the first ring.

5. The apparatus of claim 1, further comprising:

at least four guide elements on the car, wherein a first set of at least two of the at least four guide elements fits about an inside of the stationary guide track and a second set of at least two of the at least four guide elements fits about an outside of the stationary guide track.

6. The apparatus of claim 4, wherein the structure of the second ring for attaching to the corresponding structure of the first ring is configured to mate and attach to the first ring, wherein the second ring comprises at least one protrusion and the corresponding structure of the first ring comprises at least one groove configured to receive and mate with the at least one protrusion on the second ring, and wherein the at least one protrusion is telescopically extendable and retractable.

7. The apparatus of claim 4, wherein the second ring is mated and attached to the first ring.

8. The apparatus of claim 1, wherein the car has a wheel for moving along the stationary guide track.

9. The apparatus of claim 2, wherein the first ring has foam padding along an inner perimeter thereof, the foam padding configured to provide comfort when resting against the user's forehead.

10. The apparatus of claim 9, wherein the first ring has a protective material covering the foam padding.

11. The apparatus of claim 1, wherein the source of resistance is selected from the group consisting of: a bungee cord, a kettle bell, a spring under tension, a cable cross over machine, a Pilates machine, a weight stack, a weighted exercise ball, a pillar, a column, a hook on a wall, and a parachute.

12. An apparatus for exercising a body part of a user, comprising:

a first ring configured to be worn around the body part of the user, the first ring having a stationary guide track therein; and a car having an attachment port that fits and moves around the stationary guide track for connection to a source of resistance, the car configured to fit within the stationary guide track of the first ring and to move along the stationary guide track, whereby as the user freely moves the body part at any angle, the car adjusts its positioning along the stationary guide track while maintaining a substantially stable position of the attachment port relative to the source of resistance, thereby enhancing the user's range of motion and comfort during exercise; and at least four guide elements on the car, wherein a first set of at least two of the at least four guide elements fits about an inner periphery of the stationary guide track and a second set of at least two of the at least four guide elements fits about an outer periphery of the stationary guide track, wherein the car includes two or more separable pieces and is configured to open up about a pivot axis for loading and unloading about the stationary guide track, and wherein the stationary guide track is for the loading and unloading of the car.

13. The apparatus of claim 12, further comprising:

a harness configured to be worn by the user, the harness having a structure along an outer perimeter thereof for attaching to a corresponding structure along an inner perimeter of the first ring or along an inner perimeter of a second ring.

14. The apparatus of claim 12, further comprising:

a belt configured to be worn by the user, the belt having a structure along an outer perimeter thereof for attaching to a corresponding structure along an inner perimeter of the first ring, wherein the first ring is selected from a plurality of first rings having different sizes.

15. An apparatus for exercising a body part of a user, comprising:

a first ring configured to be worn around the body part of the user, the first ring having a stationary guide track therein;

a second ring that fits against the first ring, wherein the first ring is an inner ring and the second ring is an outer ring; and a car having an attachment port that fits between the stationary guide track and the second ring and moves around the stationary guide track for connection to a source of resistance, the car configured to fit within the stationary guide track of the first ring and to move along the stationary guide track, whereby as the user freely moves the body part at any angle, the car adjusts its positioning along the stationary guide track while maintaining a substantially stable position of the attachment port relative to the source of resistance, thereby enhancing the user's range of motion and comfort during exercise; and at least four guide elements on the car, wherein a first set of at least two of the at least four guide elements fits about an inner periphery of the stationary guide track and a second set of at least two of the at least four guide elements fits about an outer periphery of the stationary guide track, wherein the car includes two or more separable pieces and is configured to open up about a pivot axis for loading and unloading about the stationary guide track, and wherein the stationary guide track is provided for the loading and unloading of the car.

* * * * *